US005850582A

United States Patent [19]

Inoo et al.

[11] Patent Number: 5,850,582

[45] Date of Patent: Dec. 15, 1998

[54] ADMINISTRATIVE DEVICE FOR IMAGE FORMING APPARATUS

[75] Inventors: Masaaki Inoo, Toride; Shinichi Nakamura, Kawasaki; Shunji Sato, Sapporo; Satoshi Choho, Tokyo; Takeshi Sekiya, Toride, all of Japan

[73] Assignee: Canon Kabushiki Kaisha, Tokyo, Japan

[21] Appl. No.: 982,350

[22] Filed: Dec. 2, 1997

[30] Foreign Application Priority Data

| | | | |
|---|---|---|---|
| Dec. 2, 1996 | [JP] | Japan | 8-321609 |
| Jan. 8, 1997 | [JP] | Japan | 9-011874 |
| Jan. 8, 1997 | [JP] | Japan | 9-011875 |
| Jan. 8, 1997 | [JP] | Japan | 9-011876 |
| Jan. 8, 1997 | [JP] | Japan | 9-011877 |

[51] Int. Cl.[6] ..... G03G 15/00; G03G 21/02

[52] U.S. Cl. ..... 399/8; 399/10; 399/21; 399/42

[58] Field of Search ..... 399/8, 9, 10, 21, 399/42

[56] References Cited

U.S. PATENT DOCUMENTS

| | | | |
|---|---|---|---|
| 4,712,908 | 12/1987 | Nakayama et al. . | |
| 4,940,225 | 7/1990 | Sato et al. . | |
| 5,140,380 | 8/1992 | Nakamura et al. . | |
| 5,177,548 | 1/1993 | Nakamura et al. . | |
| 5,205,549 | 4/1993 | Sato et al. . | |
| 5,240,362 | 8/1993 | Nakamura et al. . | |
| 5,253,024 | 10/1993 | Okuda et al. . | |
| 5,363,023 | 11/1994 | Choho . | |
| 5,365,314 | 11/1994 | Okuda et al. . | |
| 5,386,271 | 1/1995 | Maekawa et al. | 399/8 |
| 5,420,679 | 5/1995 | Goto et al. . | |
| 5,446,523 | 8/1995 | Shimomura et al. | 399/42 |
| 5,464,964 | 11/1995 | Okuda et al. . | |
| 5,534,987 | 7/1996 | Ohtsuka et al. . | |
| 5,592,276 | 1/1997 | Ohtsuka et al. . | |
| 5,592,280 | 1/1997 | Ishizuka et al. . | |
| 5,610,689 | 3/1997 | Kamiya et al. | 399/42 X |
| 5,671,917 | 9/1997 | Choho et al. . | |

*Primary Examiner*—R. L. Moses

*Attorney, Agent, or Firm*—Fitzpatrick, Cella, Harper & Scinto

[57] ABSTRACT

A host computer 104 at a remote administrative site receives a jam code and the number of accumulated copies made from a photocopier 100 at which jamming has occurred, an accumulated jam curve is calculated based on the received data, a certain filtering process is performed, the risk of jamming is estimated based on the filter output and a membership function between the filter value and risk, thus judging whether or not to visit the user.

45 Claims, 21 Drawing Sheets

| JAM CODE | COUNTER VALUE | DATE | TIME |
|---|---|---|---|
| 0101 | 10002 | 1993.10.1 | 10 : 12 |
| 0201 | 10010 | 1993.10.2 | 11 : 35 |
| 0102 | 10100 | 1993.10.3 | 09 : 55 |
| 0202 | 10300 | 1993.10.4 | 15 : 45 |
| ⋮ | ⋮ | ⋮ | ⋮ |

| DATE | TIME | JAM CODE | COUNTER VALUE |
|---|---|---|---|

CASE WHERE COMMUNICATION FREQUENCY IS HIGH

CASE WHERE COMMUNICATION FREQUENCY IS LOW

FIG. 25

| |
|---|
| JAM DETECTION MODULE |
| MODULE FOR DETECTING THE NUMBER OF TIMES OF PHOTOCOPYING OPERATION |
| JAM INFORMATION STORAGE MODULE |
| FIRST CALCULATING MODULE |
| SECOND CALCULATING MODULE |
| RISK JUDGING MODULE |
| RISK OUTPUT MODULE |
| ADMINISTRATION MODULE |
| COMMUNICATION CONTROL MODULE |
| FIRST COMMUNICATION MODULE |
| SECOND COMMUNICATION MODULE |
| THRESHOLD VALUE PROCESSING MODULE |
| STATUS JUDGMENT MODULE |
| JUDGMENT INPUT MODULE |
| JUDGMENT PROCESSING-VARIABLE MODULE |

ADMINISTRATIVE DEVICE FOR IMAGE FORMING APPARATUS

BACKGROUND OF THE INVENTION

1. Field of the Invention

The preset invention relates to remote diagnosis of image forming apparatuses having jam diagnosis predicting functions.

2. Description of the Related Art

Known systems which perform administration over a plurality of photocopiers from a host computer at an administrating site via public lines involve an arrangement wherein jam information which has occurred within a photocopier is stored as such in a storage device of the host computer, and an operator at the administrating site can refer to jam information relating to each photocopier, as necessary.

However, with such a system the operator at the administrating site must constantly perform surveillance of jam occurrence status, and so a large number of the operators are required to deal with an increased number of photocopiers to manage. Also, in the event that there is a sudden increase in the frequency of jamming, the judgment of whether or not to deploy a serviceman depends on the operator, so the quality of service under such a system is not necessarily uniform.

SUMMARY OF THE INVENTION

Accordingly, it is an object of the present invention to provide an administrative device for image forming apparatuses and an administrative method thereof, for dealing with the above-described shortfalls.

It is another object of the present invention to provide an administrative device for image forming apparatuses and an administrative method thereof, which is capable by host computer of automatically performing duties such as surveillance of jamming status and decision-making for serviceman deployment, thereby reducing costs and providing stable service to the user.

It is yet another object of the present invention to provide an administrative device for image forming apparatuses and an administrative method thereof, which is capable of performing risk judgment optimal for jamming.

It is a further object of the present invention to provide an administrative device for image forming apparatuses and an administrative method thereof, which is capable of markedly improving the availability of image forming apparatuses.

Other objects and features of the present invention will become clear from the following description made with reference to the accompanying drawings, and from the claims.

BRIEF DESCRIPTION OF THE DRAWINGS

FIG. 25 is a diagram illustrating each module of the program stored in the storage medium.

DETAILED DESCRIPTION OF THE PREFERRED EMBODIMENTS

The following is a description of embodiments of the present invention with reference to the drawings.

First Embodiment

Figure 1:
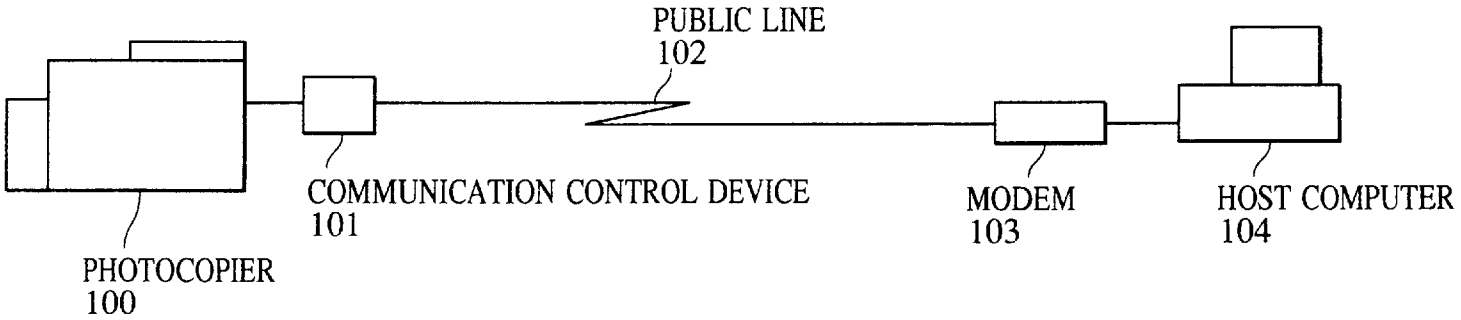
FIG. 1 is a diagram illustrating an overall view of a system to which the present invention can be applied.

FIG. 1 is a conceptual diagram illustrating an overall view of a system to which the present invention can be applied. 100 denotes a photocopier for making a specified number of copies of an original, 101 denotes a communication control device which is connected to the photocopier 100 for sending and receiving of data, 102 denotes a public line which is a communications line, 103 denotes a modem which facilitates sending and receiving of digital data via the public line 102, and 104 denotes a host computer which is at a remote administrative site for storing and computing the data for the photocopier 100.

Figure 2:
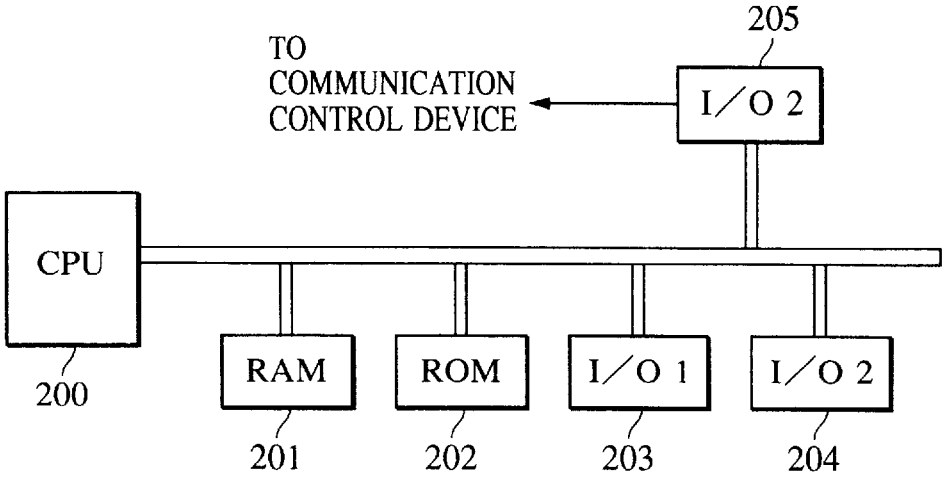
FIG. 2 is a diagram illustrating the configuration of a photocopier.

FIG. 2 is a diagram illustrating the configuration of the electrical circuitry of the photocopier 100. 200 denotes a CPU, which controls the overall apparatus. 201 denotes RAM which is used as a working area for the CPU 200 and a storage area for control data. 202 denotes ROM for storing a control program, 203 and 204 denote I/O for performing sensor checks and motor driving, and 205 denotes an I/O for performing communication with the communication control device.

Figure 3:
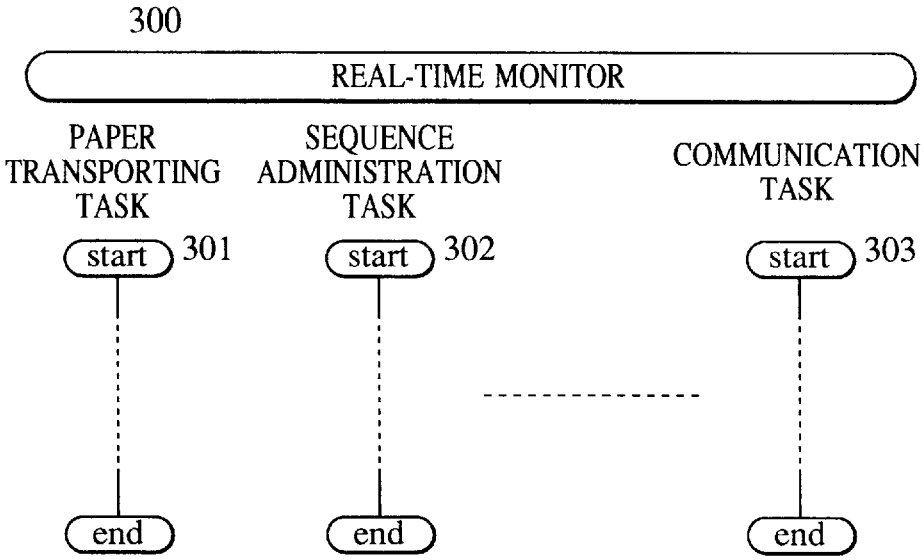
FIG. 3 is a diagram illustrating the configuration of software for the photocopier.

FIG. 3 is a diagram illustrating the configuration of software for the photocopier 100. 300 denotes a real-time monitor, and is used for managing a plurality of tasks at the same time. 301 denotes a paper transporting task, which is a task that controls the process from feeding paper to ejecting paper, for one sheet of paper. 302 denotes a sequence control task, which is a task that manages the overall photocopier. 303 denotes a communications task, which is a task for performing communication with the communicating control device 101.

Figure 4:
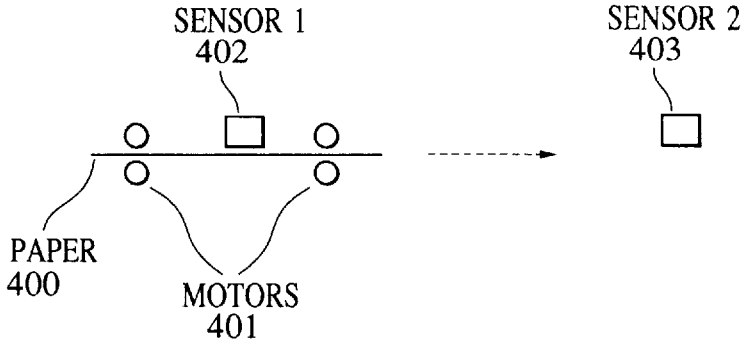
FIG. 4 is a diagram illustrating paper transporting.

FIG. 4 is a diagram illustrating the paper transporting unit of the photocopier 100. 400 denotes paper being transported, 401 denotes driving motors, 402 and 403 denotes sensors for detecting the position of the paper.

Figure 5:
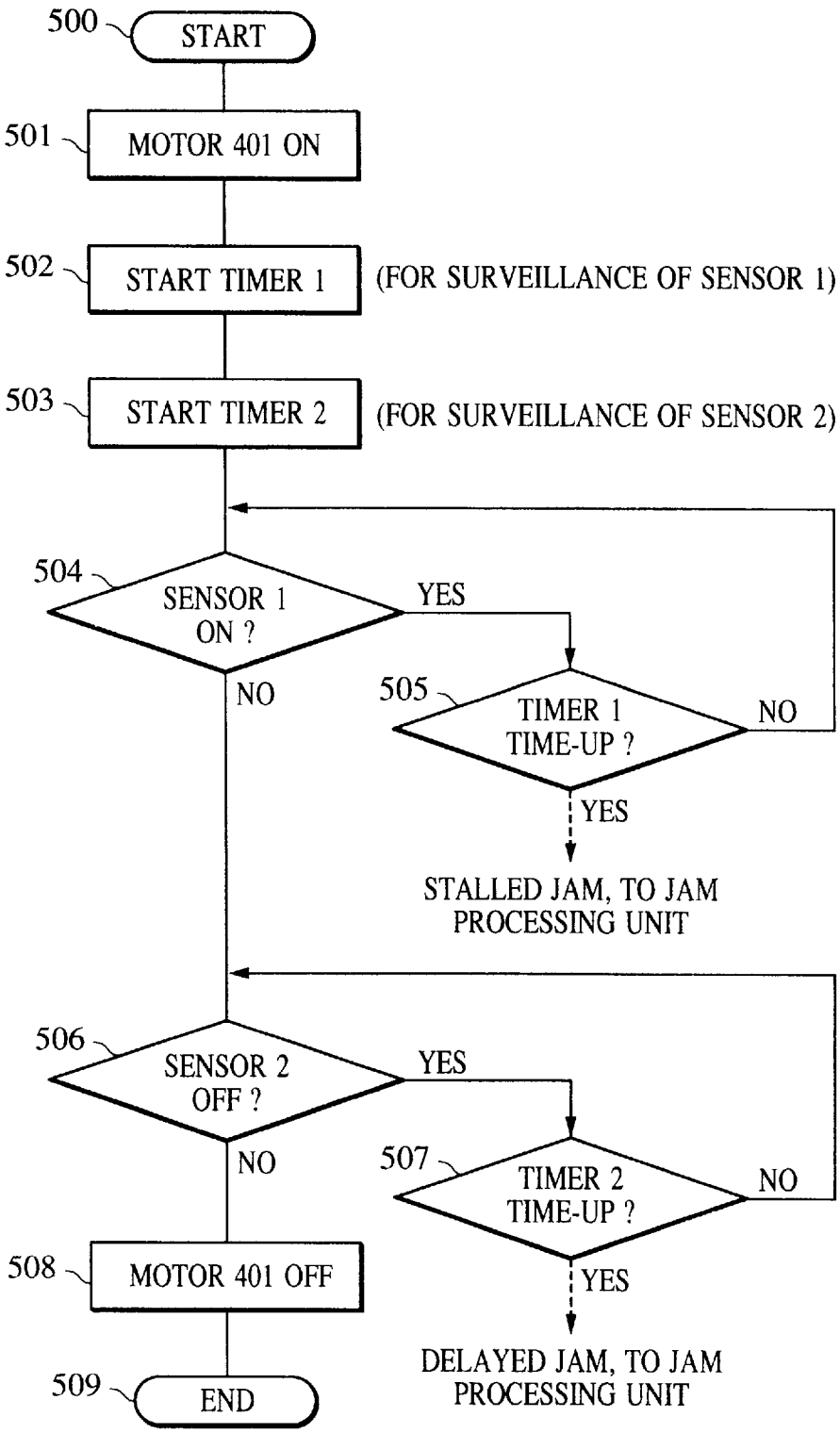
FIG. 5 is a flowchart illustrating a jam detection processing routine.

Next, a description will be made of the jam detecting process operation of the photocopier 100 with reference to FIG. 5. FIG. 5 is a flowchart illustrating a jam detection processing routine of the photocopier 100. The jam detection processing routine shown in FIG. 5 is executed by means of the CPU 200 following the control program stored in ROM 202.

In order to transport paper, first, the driving motor 401 is turned on (step 501), and a first timer for performing surveillance of the sensor 402 and a second timer for performing surveillance of the sensor 403 are started (steps 502 and 503). Subsequently, the system waits for the sensor 1 to go off within the time set by the first timer, i.e., for the paper to depart from the sensor 1 (steps 504 and 505). In the event that the first timer exceeds the predetermined time limit, judgment is made that a stalled jam of paper has occurred, and the process jumps to the jam processing routine. After the sensor 1 has turned off, surveillance of the sensor 2 is performed, and the system waits for the sensor 2 to go on within the time set by the second timer, i.e., waits for the paper to be detected (steps 506 and 507). In the event that the second timer exceeds the predetermined time limit, judgment is made that a delayed jam of paper has occurred, and the process jumps to the jam processing routine. Once the transporting of paper has been completed, the motor 401 is turned off (step 508).

Figure 6:
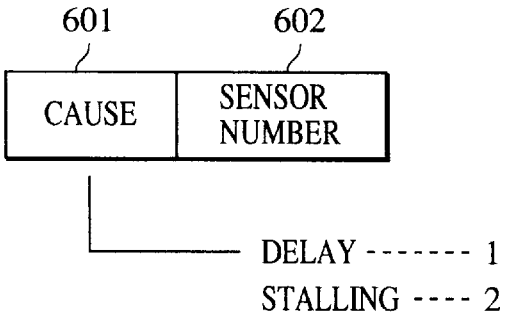
FIG. 6 is a diagram illustrating a jam code.

FIG. 6 is a diagram illustrating a jam code. The jam code is comprised of a cause 1601 and sensor No. 602, thus indicating the cause (delayed jam or stalled jam) regarding the No. sensor which has detected the jam.

Figure 7:
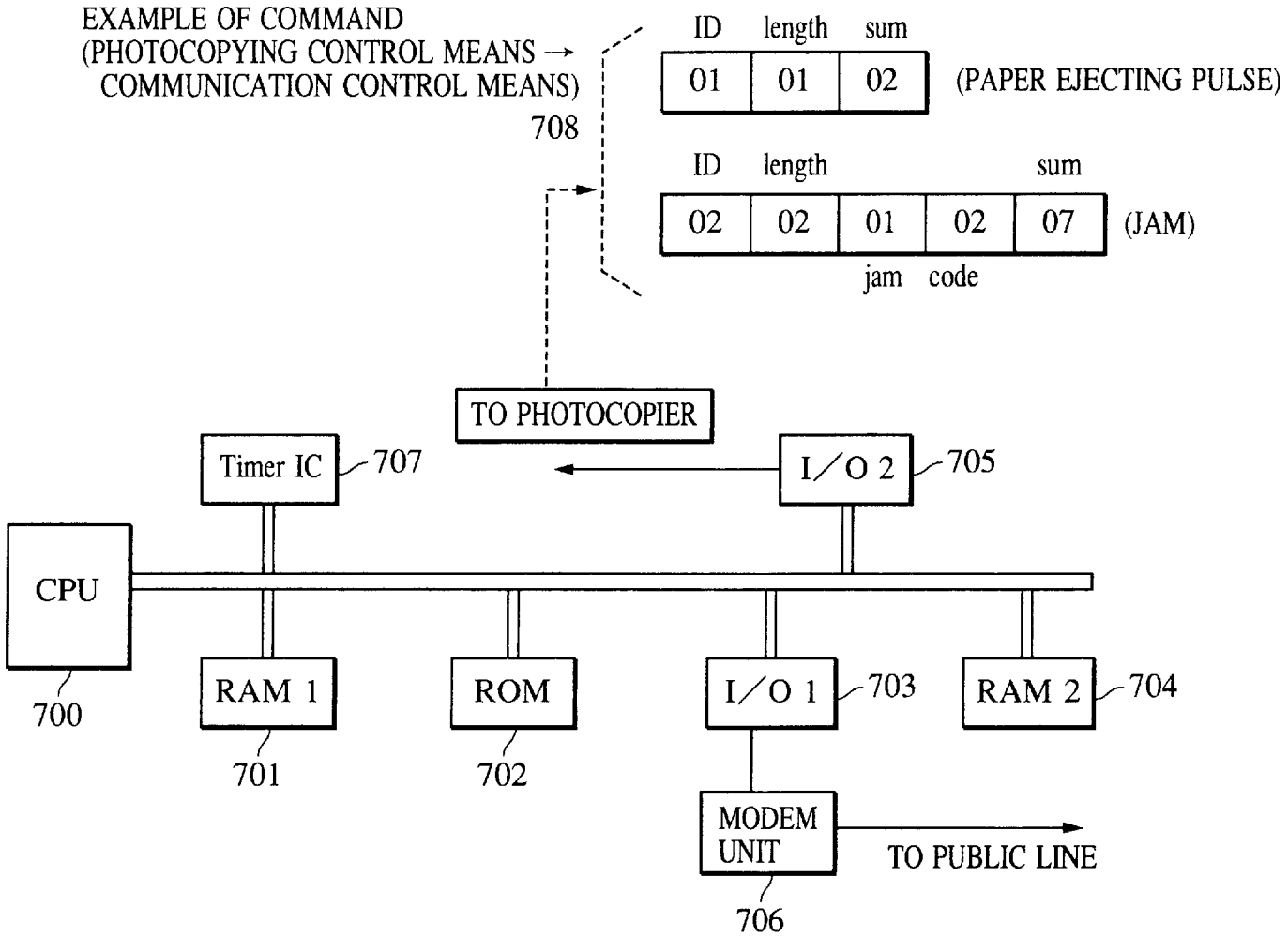
FIG. 7 is a diagram illustrating the configuration of a communication control device.

FIG. 7 is a diagram illustrating the internal configuration of the communication control device 101. 700 denotes a CPU which controls the overall device, 701 denotes a RAM 1 which is working area necessary for the CPU 700 to operate, 702 is ROM which stores programs for the operation of the CPU 700, 703 denotes a serial interface for communication with the modem 706, 704 RAM 2 is a battery backed-up for storing jam information and various copy counter values, 705 denotes a serial interface for communications with the CPU 200 of the photocopier 100, and 707 denotes a timer IC for managing time. 708 denotes an example of communication commands between the photocopier 100 and the communication control device 101. ID denotes the type of command, "length" indicates the data length, and "sum" is a bit for detecting communication error. The communication command illustrated in the example is data which is sent from the photocopier 100 to the communication control device 101 at the point that a paper ejecting count pulse (ID=01) and jam (ID=02) occur at the photocopier 100. The number of copies made can be known by the communication control device 101 counting count, pulses (ID=01) at the time of ejecting paper, and the type of jam is identified the jam code in the event that a jam (ID=02) occurs.

Figure 8:
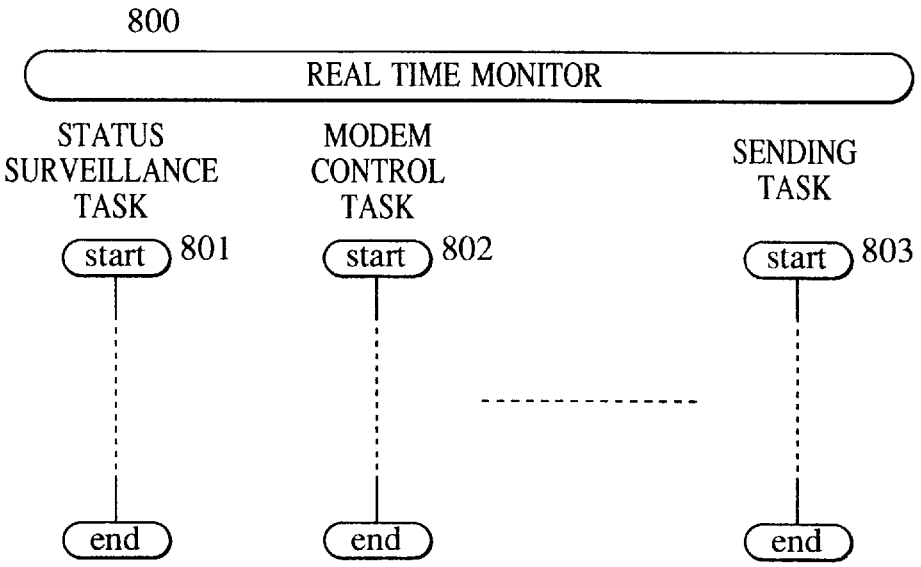
FIG. 8 is a diagram illustrating software for the communication control device.

FIG. 8 is a conceptual diagram illustrating software for the communication control device 101. 800 denotes a real-time monitor, and is used for managing a plurality of tasks at the same time. 801 is a status surveillance task, constantly performing surveillance of the state of the photocopier 100. 802 is a modem control task, for performing control of the modem in order to facilitate sending and receiving. 803 denotes a sending and receiving task, which is a task for sending data to the host computer 104.

Figure 9:
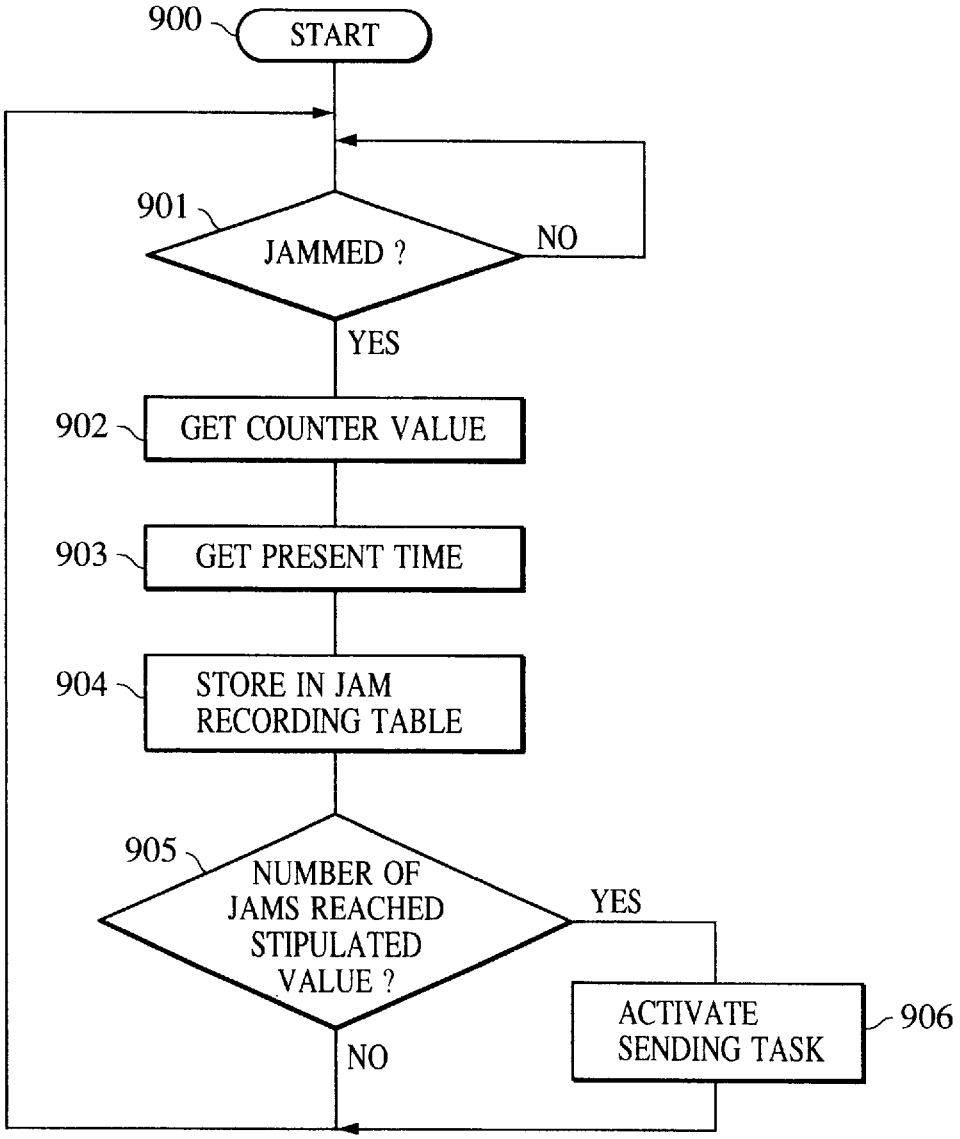
FIG. 9 is a flowchart illustrating a status surveillance task.

FIG. 9 is a flowchart illustrating a status surveillance task 801 of the communication control device 101. The status surveillance processing routine shown in FIG. 9 is executed by the CPU 700 following a control program stored in the ROM 702.

Surveillance of jam occurrence at the photocopier 100 is performed (step 901), and if a jam occurs the counter value and current time at that point in time are obtained (steps 902 and 903), and stored in the jam recording table in the RAM 2 (step 904). Subsequently, judgment is made whether of not the number of occurrences of jamming stored in the jam recording table has reached the stipulated value (step 905), and if the value has been reached, the sending task is initiated (step 906), which makes a telephone call to the host computer 104 at the remote administrative site, and sends the contents of the jam recording table.

Figures 10, 12:
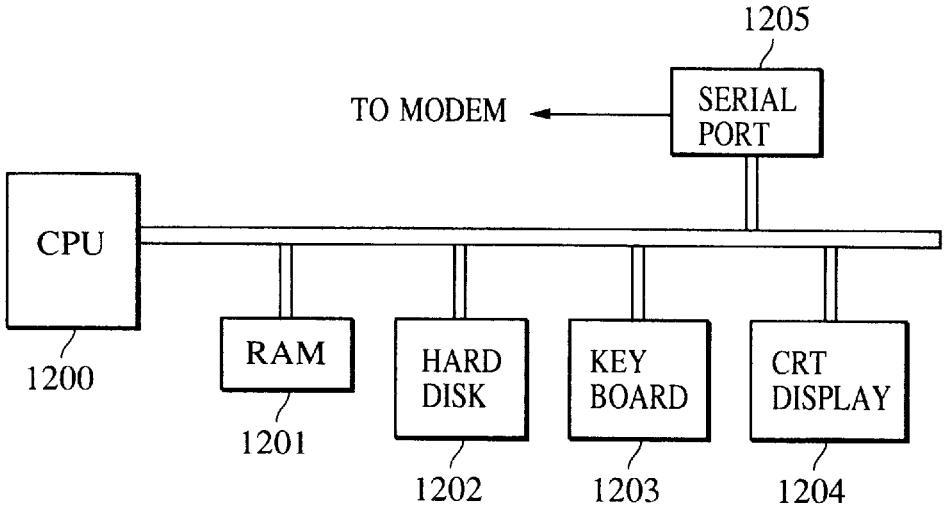
FIG. 10 is a diagram illustrating a jam recording table.
FIG. 12 is a diagram illustrating the configuration of the host computer.

FIG. 10 is a diagram illustrating a jam recording table. The CPU 700 records "jam code, counter value, date, time" as a single record each time a jam occurs.

Figure 11:
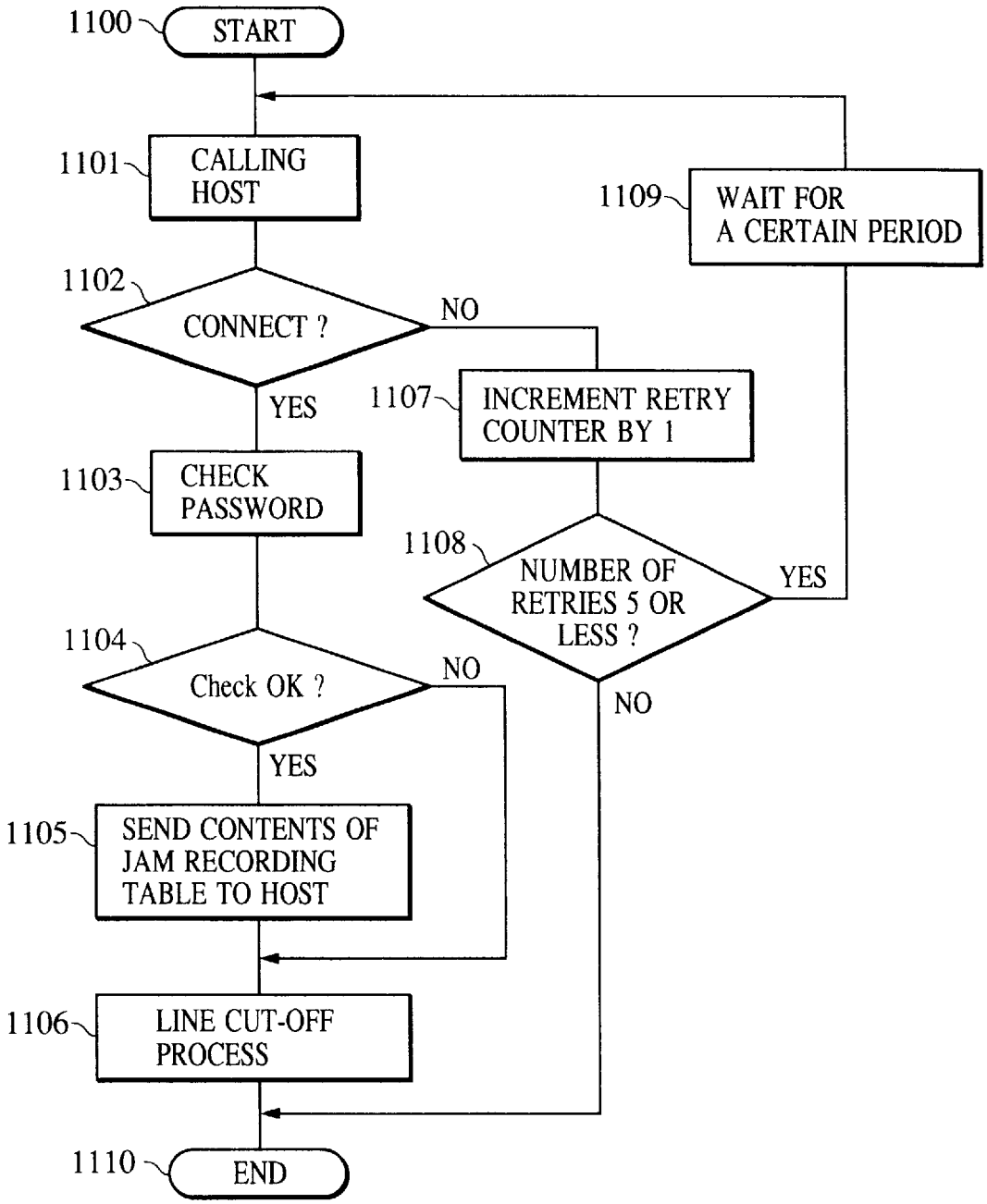
FIG. 11 is a flowchart illustrating a sending task.

FIG. 11 is a flowchart illustrating a sending task 803 of the communication control device 101. The data sending processing routine illustrated in FIG. 11 is executed by the CPU 700 following a control program stored in the ROM 702.

In order to send data, the sending task is initiated, and first makes a telephone call to the host computer 104 at the administrative site (step 1101). Subsequently, a check is made whether or not proper connection has been made with the host computer 104 at the administrative site (step 1102). In the event that the attempt to connect fails, up to five retries are made following a certain amount of time. In the event attempt to connect fails even after five retries, the process is ended (steps 1107, 1108, 1109). In the event that a proper connection is made, a password check is performed (step 1103). i.e., the ID of the communication control device 101 is sent to the host computer 104, and comparison is made between the password sent from the host computer 104 and the password held by the communication control device 101 (step 1104). In the event that the passwords do not match, a signal is sent indicating a failure, and line cut-off processing is performed (step 1106). In the event that the passwords match, an OK signal is sent, and the contents of the jam recording table are sent to the host computer 104 (step 1105). Following sending of data, line cut-off processing is performed (1106), and the present task thus is completed.

FIG. 12 is a diagram illustrating the configuration of the host computer 104. 1200 denotes a CPU, controlling the overall computer. 1201 denotes RAM storing programs and data necessary for the CPU 1200 to perform data processing. 1202 denotes a hard disk for saving received data, the jam data all being saved here. 1203 denotes a keyboard for the operator to issue instructions from. 1204 denotes a display device for outputting information of the host computer 104. 1205 denotes a serial port for sending and receiving data with the modem 103.

Figure 13:
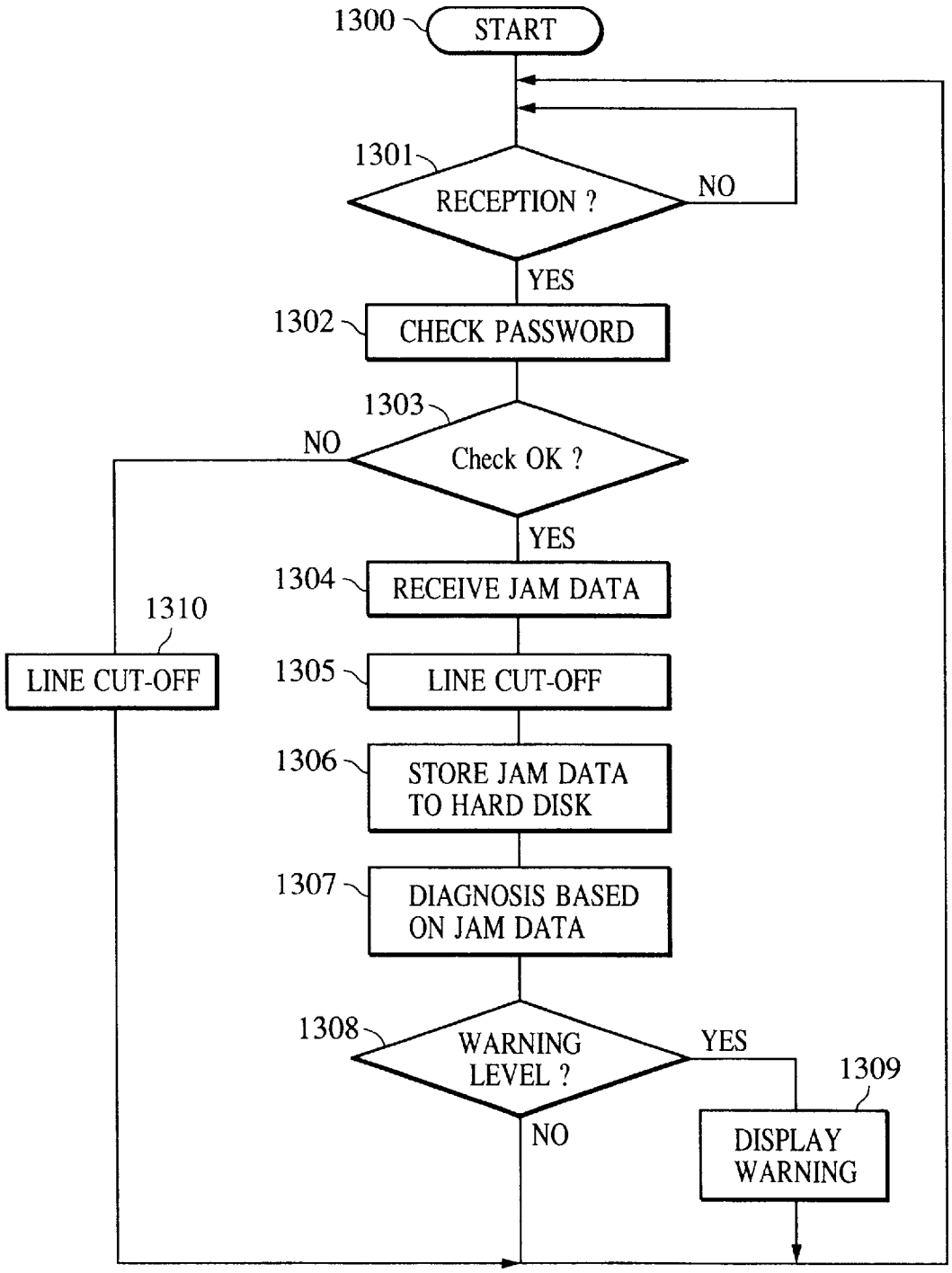
FIG. 13 is a flowchart illustrating the processing of the host computer.

FIG. 13 is a flowchart illustrating the processing of the host computer 104. The processing routine illustrated in FIG. 13 is executed by the CPU 1200 following control programs stored in the RAM 1201.

When the host computer 104 is not performing processing other than administration of photocopiers, the host computer 104 is generally in a state of waiting for reception signals from the modem 103 (step 1301). In the event there is reception, a password check is performed (step 1302). i.e., the ID sent from the communication control device is used for searching the ID and password table within the hard disk 1202 and judging from which communication control device the reception has been made, following which the corresponding password is sent to the communication control device. In the event that a signal indicating a failure is received from the communication control device (step 1303), the line is disconnected (step 1310), and in the event that a signal indicating OK is received (step 1303), jam data is received (step 1304). Once the data is received, the line is disconnected (step 1305), and the jam data is stored in the hard disk 1202 (step 1306). Subsequently, diagnosis processing is performed based on the jam data (step 1307). In the event that the diagnosis results reach a warning level, a warning is displayed on the display 1204, calling attention to the operator (steps 1308 and 1309).

Next, the jam diagnosis processing method will be described.

Figure 14:
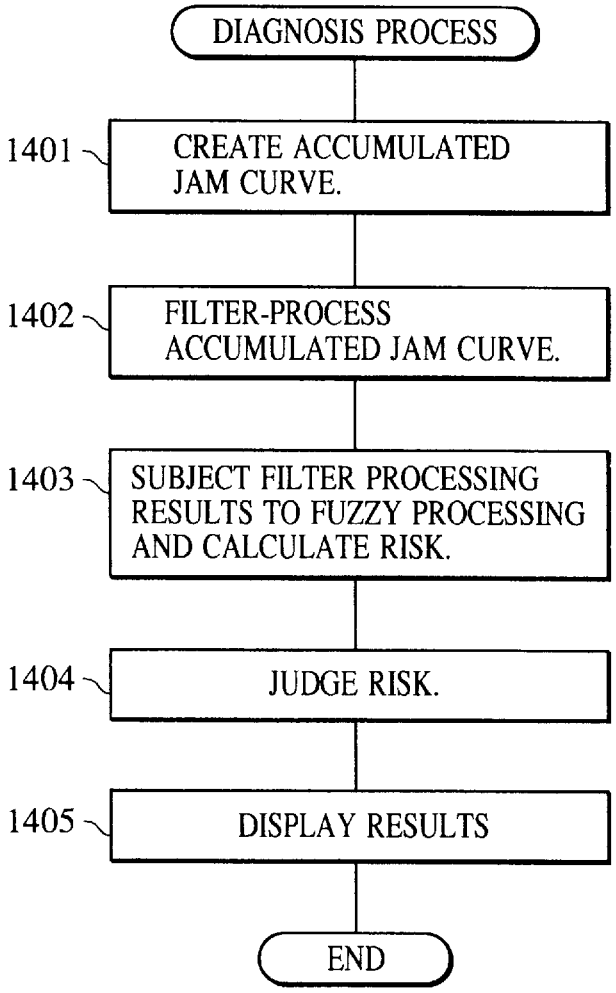
FIG. 14 is a flowchart illustrating jam diagnosis processing.

FIG. 14 is a flowchart illustrating the jam diagnosis processing method.

Figures 15, 16:
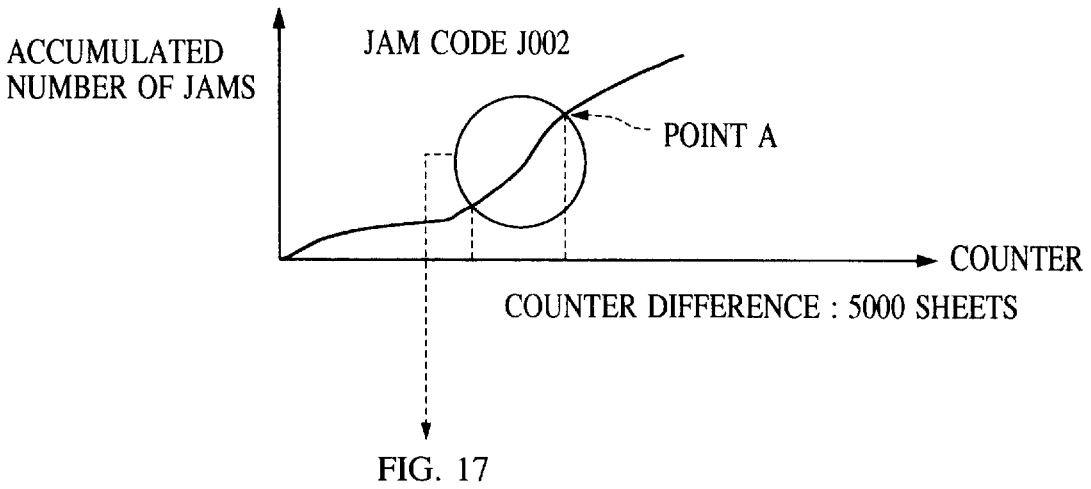
FIG. 15 is a diagram illustrating jam data.
FIG. 16 is a diagram illustrating an accumulated jam curve.

In step 1307, the jam data stored in the hard disk 1202, comprised four pieces of data, namely, date, time, jam code, and counter value, as shown in FIG. 15, is classified by a photocopier under administration of the communication control device 101, and is stored in the hard disk 1202.

First, based on the jam data stored in the hard disk 1202, an accumulated jam curve such as shown in FIG. 16 is created for each jam code, with the counter value as the horizontal axis and with the accumulated number of jams as the vertical axis (step 1401).

Figure 17:
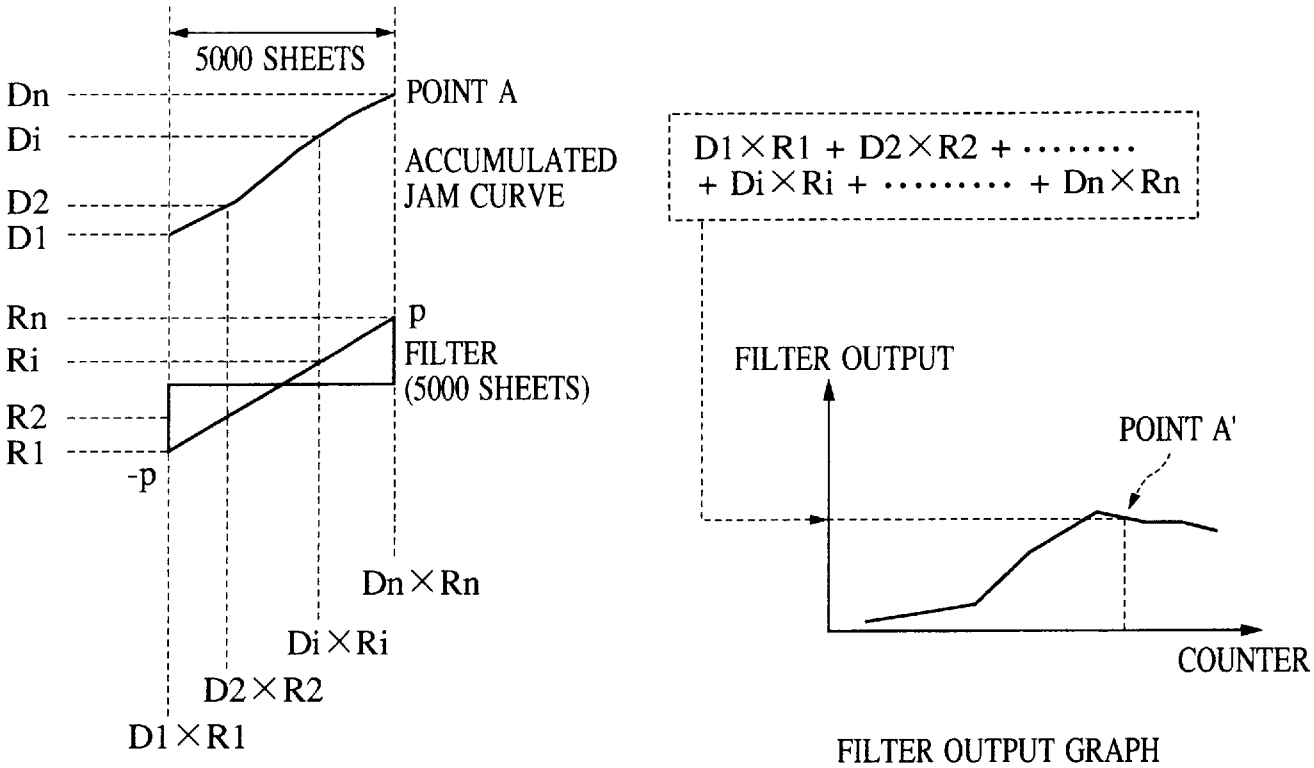
FIG. 17 is a diagram for describing the filter process.

Next, filtering using an FIR filter is performed to the accumulated jam curve in order to extract and emphasize certain data components (step 1402). This filter has linear properties. FIG. 17 shows the processing of the area encircled in FIG. 16 with a filter length of 5,000 sheets.

With the filter output value of the past 5,000 sheets as to point A in the figure denoted by point A', point A' can be calculated as follows:

$$D1\times R1+D2\times R2+\ldots+Di\times Ri+\ldots+Dn\times Rn$$

Di represents the number of accumulated jams at each point with the filter length equally divided by n−1, and Ri is the filter output value of each point. Point A is shifted 100 sheets at a time to the right following the accumulated jam curve, calculating point A' each time, thereby creating a filter output graph with the counter value as the horizontal axis and the filter output value as the vertical axis.

Figure 18:
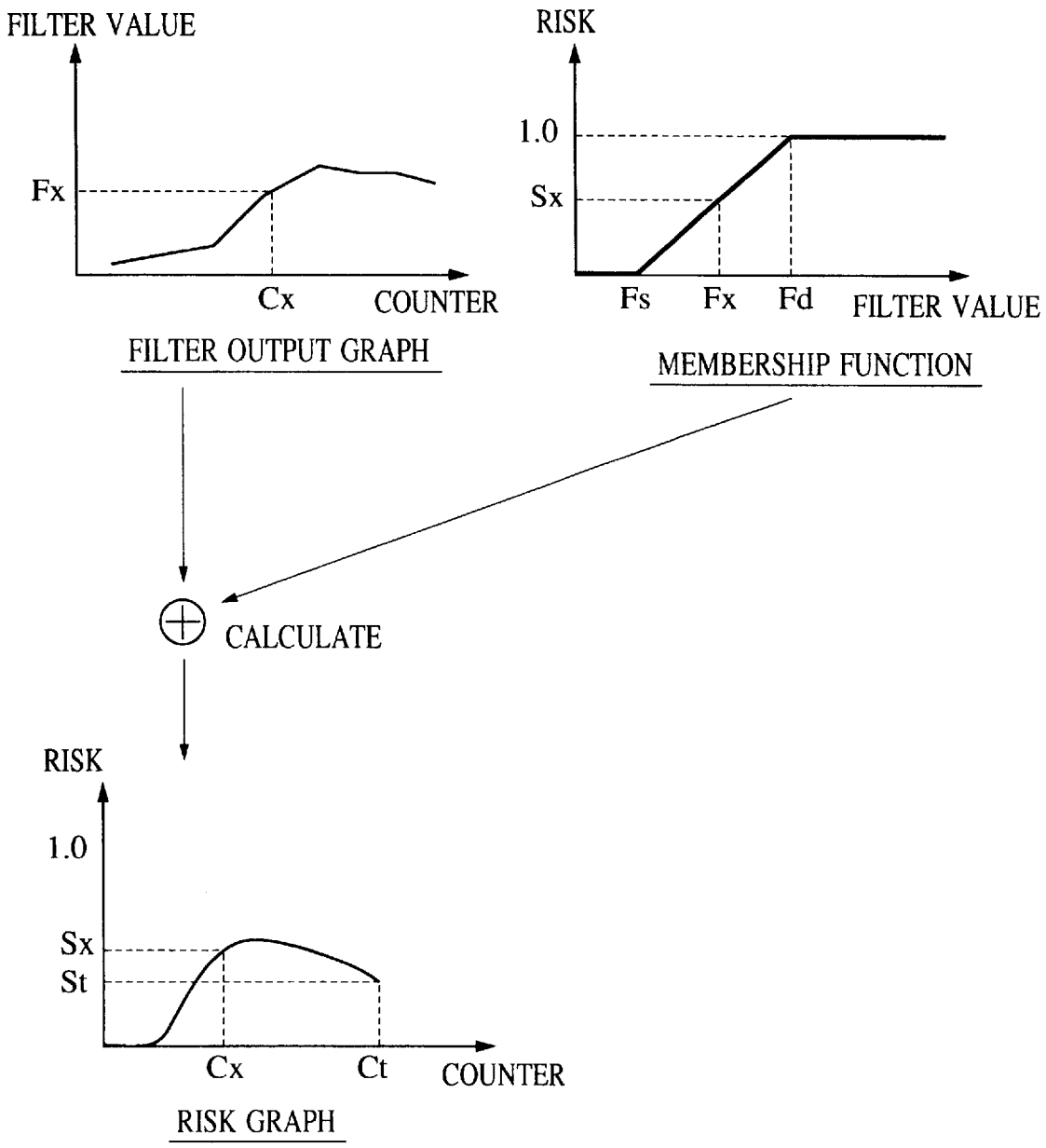
FIG. 18 is a diagram for describing the calculation of risk.

Next, fuzzy processing is performed to the filter output graph obtained in step 1402, thereby calculating risk (step 1403). This is illustrated in FIG. 18. In order to calculate the risk, a membership function with the filter value as the horizontal axis and risk as the vertical axis is created. Herein, 0 represents a safe value, 1 represents a danger value, and risk can be represented between 0 and 1. Using this membership function, calculating processing is performed regarding the aforementioned filter output graph, thus obtaining a risk graph with the counter value as the horizontal axis and risk as the vertical axis. In the state of the counter value being Cx, the filter value is represented by Fx, and the risk regarding the counter value Cx is Sx.

Figure 19:
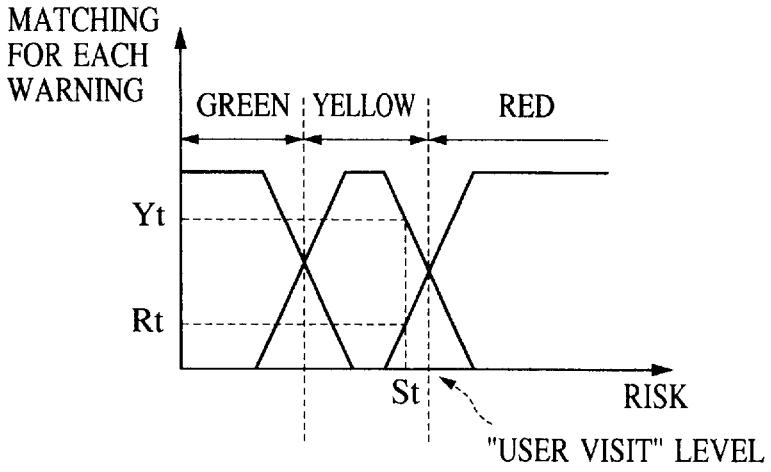
FIG. 19 is a diagram for describing judgment of risk.

Next, the risk graph obtained in step 1403 is used for risk judgment (step 1404). Here, three types of warnings are set, namely, red, yellow, and green, with membership functions being used for judgment of each. This is illustrated in FIG. 19, with risk as the horizontal axis and the degree of match with each warning as the vertical axis. In the Figure, with the risk to the count value Ct at the present point as St, the yellow level is Yt, and the red level is Rt. In the event that the risk St exceeds the "user visit" level set beforehand, a "user visit" message is output onto the display 1204 (step 1405).

Thus, the host computer automatically performs jam diagnosis and prediction according to received image forming apparatus jam information, and enables steps to be automatically taken such as deploying a serviceman if necessary. Accordingly, the number of operators needed at the administrative site can be reduced, and the users can be provided with speedy service without decrease in the quality of service even in the event that the number of photocopiers increases.

Second Embodiment

Although the length of the FIR filter was described as 5,000 sheets in the above-described first embodiment, a plurality of filters with differing lengths may be used. This will be described with reference to FIG. 20.

Step S2001 is the same as step S1401, and accordingly description thereof will be omitted. Regarding steps S2002 and S2003, the processing performed in steps S1402 and S1403 is performed regarding a plurality of FIR filters (3,000, 5,000, 10,000, 20,000) with differing lengths, and individual risk graphs are calculated for each.

Figure 20:
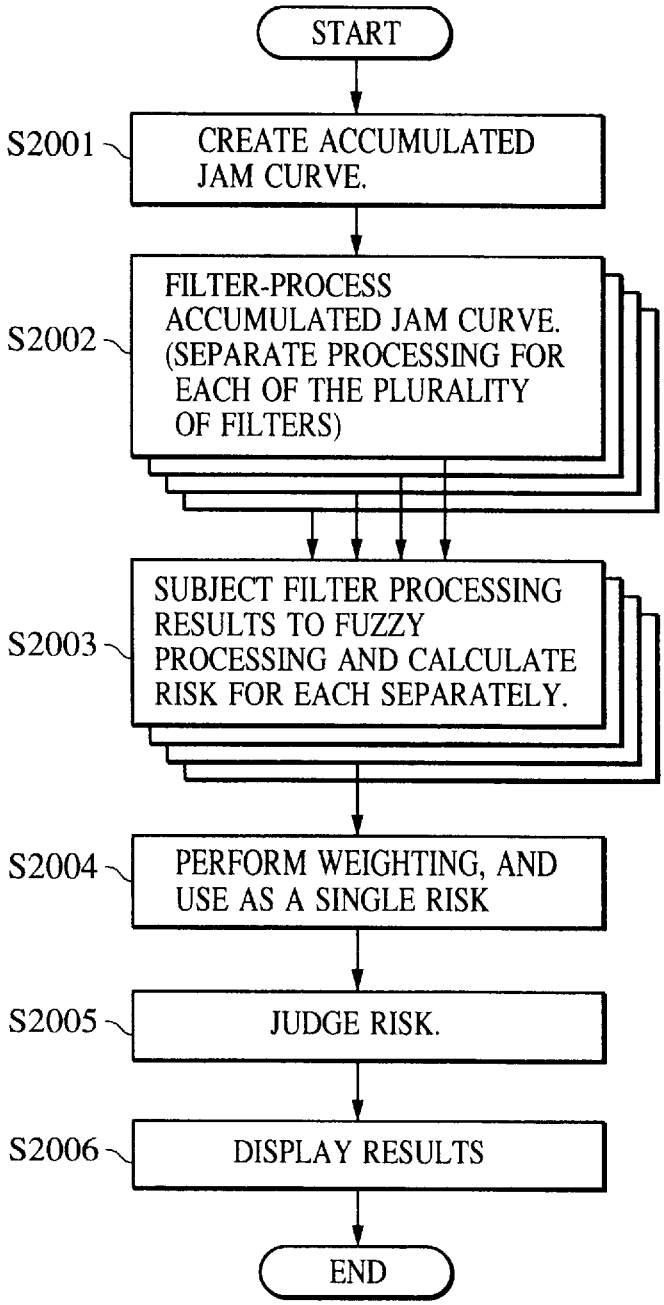
FIG. 20 is a flowchart illustrating jam diagnosis processing of a second embodiment according to the present invention.
Figure 21:
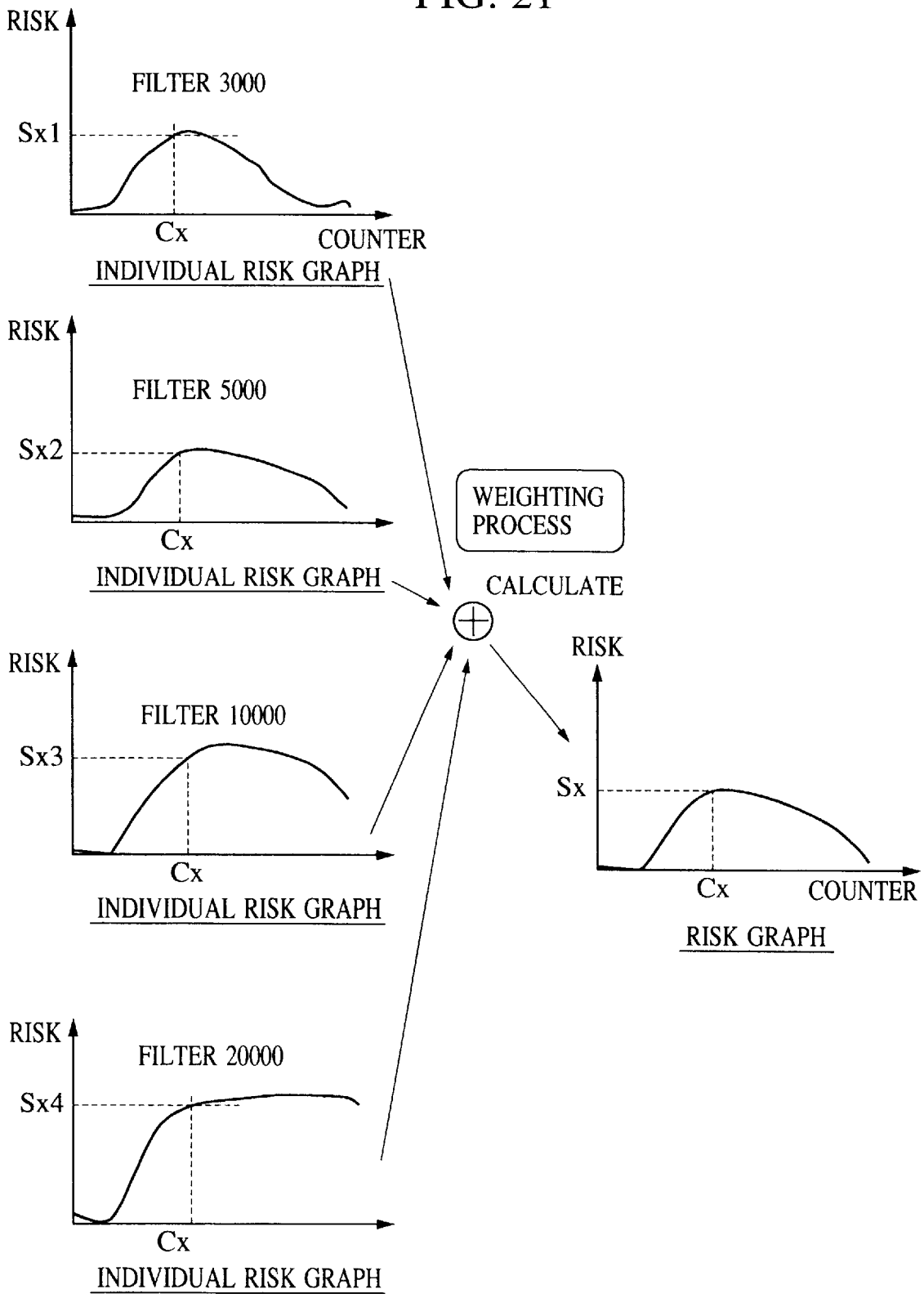
FIG. 21 is a diagram for describing the process of weighting individual risk.

Next, as shown in FIG. 20 in step 2004, each individual risk is weighted, subjected to calculating, thus obtaining a single risk graph. In the example shown in FIG. 20, weighting is calculated with the following expression (2):

$$Sx=0.2Sx1+0.3Sx2+0.3Sx3+0.2Sx4 \quad (2)$$

However, the coefficients (0.2, 0.3, 0.3, 0.2) in expression (2) are supposed values, and in actual practice, it is necessary to calculate appropriate values based on operational data.

Steps S2005 and S2006 are the same as steps S1404 and S1405, and accordingly description thereof will be omitted.

Figure 22A:
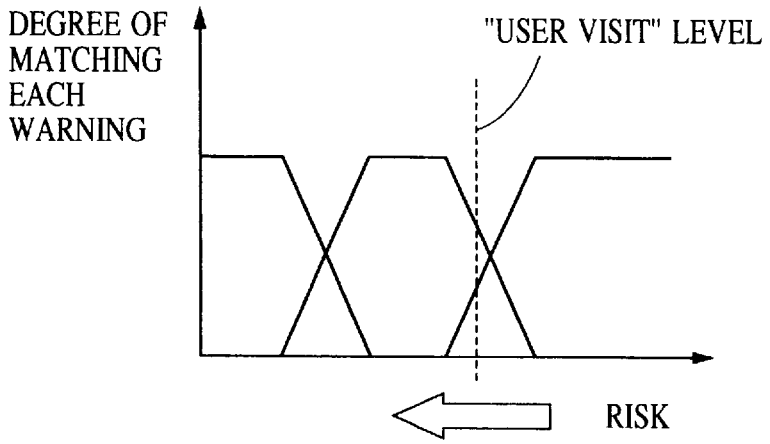
FIGS. 22A and 22B is a diagram for describing correction of the risk judgment threshold.
Figure 22B:
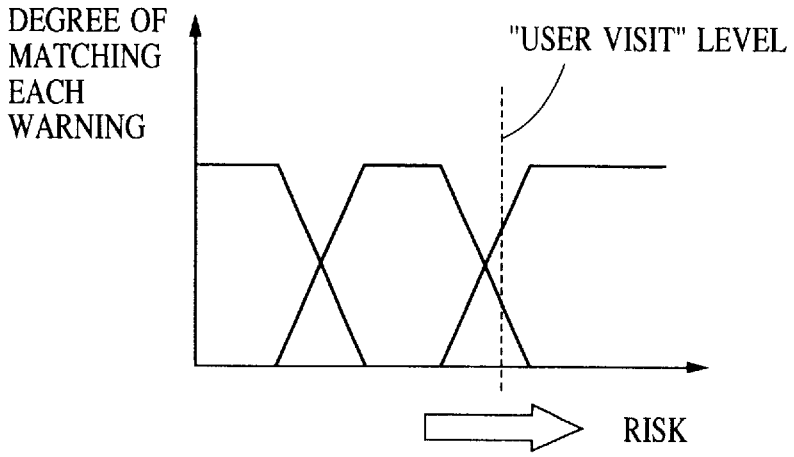

Also, an arraignment may be employed wherein past data regarding the frequency of maintenance requests from users is stored in the host computer, and this data is used to perform correction of the risk judgment threshold for each user. This is illustrated in FIG. 22. In the Figure, (a) indicates a case where the notification frequency is high, and (b) indicates a case where the notification frequency is low. In the event that the past frequency of notification from the user is high, the "user visit" level is set at a low value. In the event that the past frequency of notification from the user is low, the "user visit" level is set at a high value. Thus, even more appropriate jamming risk judgment can be made by optimizing the risk judgment threshold value in the above steps S1404 and S2005, thereby provided maintenance service according to each user.

Figure 23A:
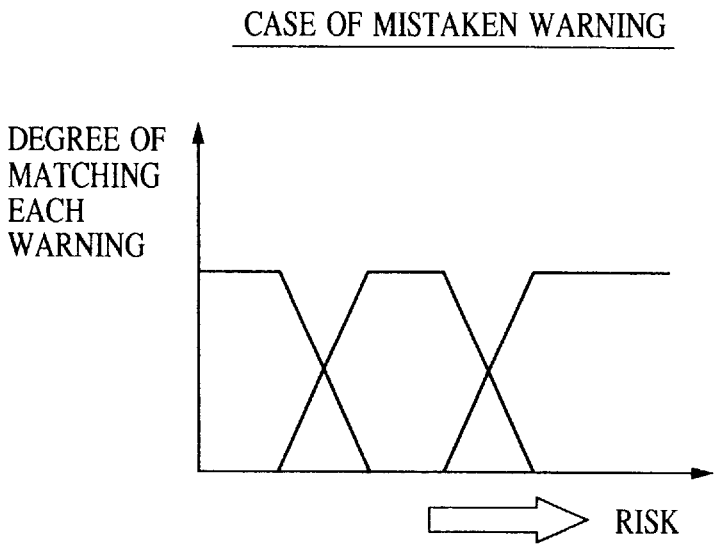
FIGS. 23A and 23B is a diagram for describing correction of the membership function.
Figure 23B:
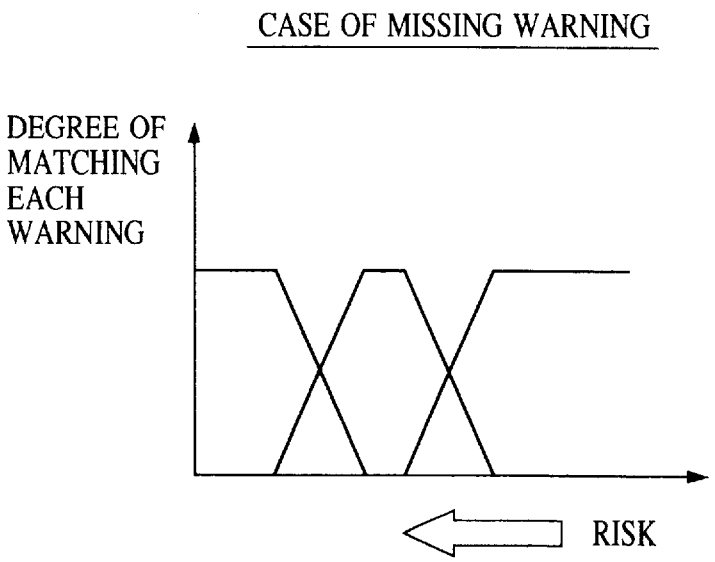

Also, an arrangement may be employed wherein, based on mistaken warning/missing warning data 2310, correction of membership functions for the degree of matching is performed according to the results thereof. This is illustrated in FIG. 23. In the Figure, (a) illustrates a case where there has been a mistaken warning, and (b) illustrates a case where there has been a missing warning. Here, the term "mistaken warning" means a false warning, i.e., the above steps S1404 and S2305 yielded risk judgment results of "user visit", but an actual visit revealed no problems with the photocopier 100. Also, the term "missing warning" means failure to issue a warranted warning, i.e., a case where the user calls in for maintenance even though a "user visit" warning has not been issued. This mistaken warning/missing warning data is input to the host computer 104 from the keyboard 1203, so as to provide feedback to the risk judgment processing in the above steps S1404 and S2305, thereby performing optimizing of the threshold value. In the event that a mistaken warning occurs, correction is made to the membership function so that "user visit" is not output until a higher level of risk is reached. On the other hand, in the event that a missing warning occurs, correction is made to the membership function so that "user visit" is output until at the present level of risk. Consequently, mistaken warnings/missing warnings decrease, and judgment of jamming risk can be made in a more appropriate manner.

Also, in the event that maintenance of the photocopier 100 has been made, there may be the need to change the filtering process following the maintenance. Following maintenance of the photocopier 100, filter processing is performed using only filters of a length within a usable range. In order to prevent the reliability of risk judgment decreasing due to a decrease in the number of filters, the risk judgment threshold is raised if there are few valid filters. Since there will generally be few malfunctions following maintenance of the photocopier 100, such processing is not particularly disadvantageous.

Figure 24:
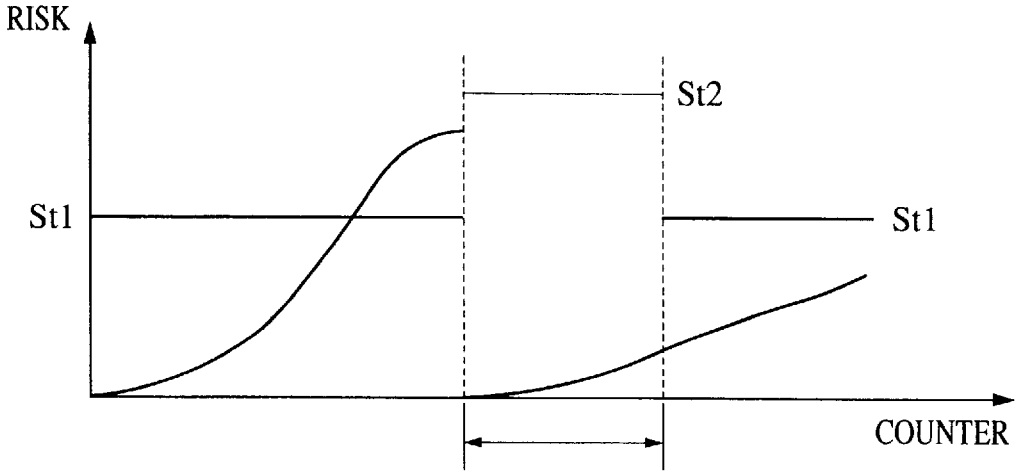
FIG. 24 is a diagram for describing risk judgment following maintenance of the image forming apparatus.

FIG. 24 is a diagram illustrating risk judgment following maintenance of the photocopier 100. In the Figure, risk judgment is performed with the threshold at St1 until maintenance is performed, but once maintenance is performed, risk judgment is performed with the threshold at St2 which is a greater threshold than the above threshold St1 due to the above reason, if the counter is within a certain count value. Subsequently, risk judgment is performed with the threshold at St1.

Third Embodiment

Next, description will be made regarding a recording medium to be used with the administrative apparatus for photocopiers according to the present invention, based on FIG. 25. Stored on the storage medium for storing control programs for controlling the administrating apparatus for photocopiers, having jamming diagnostic prediction functions using the host computer, is program code for at least the following: a "jam detection module", "module for detecting the number of times of photocopying operation", "jam information storage module", "first calculating module", "second calculating module", "risk judging module", "risk output module", "administration module", "communication control module", "first communication module", "second communication module", "threshold value processing module", "status judgment module", "judgment input module", and "judgment processing-variable module".

Now, the "jam detection module" is a program module for detecting jamming of the photocopier 100. The "module for detecting the number of times of photocopying operation" is a program module for detecting the number of times that the photocopier 100 has made copies. The "jam information storage module" is a program module for storing at the time of occurrence of jamming a jam code which indicates the type of jam which has occurred, and the latest value of the number of times of photocopying operations. The "first calculating module" is a program module for obtaining an accumulated jam curve based on data stored in the jam information storage module. The "second calculating module" is a program module for performing FIR filter (limited impulse filter) processing based on the accumulated jam curve calculated by the first calculating module and calculating the FIR filter processing results. The "risk judging module" is a program module for performing judgment of the current risk based on the FIR filter processing results obtained from the second calculating module. The "risk output module" is a program module for outputting risks judged by the risk judging module. The "threshold value processing module" is a program module for performing threshold value processing of a calculated risk. The "status judgment module" is a program module for performing status judgment based on a threshold value processed by the threshold value processing module. The "administration module" is a program module for performing administration of a plurality of photocopiers 100 by means of the host computer 140. The "communication control module" is a program module for performing surveillance of the plurality of photocopiers 100 and sending data to the host computer 104. The "first communication module" is a program module for communicating between the communication control device 101 and the photocopier 100 in order to execute the communication control module. The "second communication module" is a program module for communicating between the communication control device 101 and the host computer 104 in order to execute the communication control module. The "judgment input module" is a program module for judgment input of whether or not the output of the risk output module is correct. Finally, the "judgment processing-variable module" is a program module for allowing the judgment processing of the risk judgment module to be variable corresponding to the judgment input from the judgment input module.

Then, the host computer 104 executes the aforementioned jam information storage module, the aforementioned first calculating module, the aforementioned second calculating module, the aforementioned risk judging module, and the aforementioned risk output module.

The present invention is by no means restricted to the above embodiments, rather a variety of variations can be made within the scope of the claims.

What is claimed is:

1. An administrative device for image forming apparatuses, comprising:

receiving means for receiving number information regarding the number of sheets recorded on by the image forming apparatus and abnormality information;

first calculating means for calculating an accumulation curve of abnormalities based on the number information and the abnormality information;

second calculating means for performing filtering processing to the accumulation curve obtained by said first calculating means, so as to obtain filter output; and estimating means for estimating the risk of occurrence of abnormalities based on the filter output obtained by said second calculating means.

2. An administrative device for image forming apparatuses according to claim 1, wherein said estimating means makes fuzzy estimation of the risk of occurrence of abnormalities based on the filter output and a risk membership function.

3. An administrative device for image forming apparatuses according to claim 1, wherein said filtering process is a filtering process in which the output linearly changes proportionately with a change in the number of sheets recorded.

4. An administrative device for image forming apparatuses according to claim 1, wherein said second calculating means performed a filtering process at a plurality of points in time, each with a differing number of accumulated recording sheets, and calculates filter output.

5. An administrative device for image forming apparatuses according to claim 4, wherein said filtering processing is performed according to the number of abnormalities within a period of time corresponding to a certain number of recording sheets.

6. An administrative device for image forming apparatuses according to claim 1, wherein said abnormality information includes an abnormality code indicating the type of abnormality, and the number of accumulated recording sheets at the time of occurrence of the abnormality.

7. An administrative device for image forming apparatuses according to claim 1, wherein said abnormality includes a paper jam.

8. An administrative device for image forming apparatuses according to claim 1, further comprising judging means for judging whether or not to perform maintenance of said image forming apparatus, based on the risk estimated by said estimating means and a predetermined reference value.

9. An administrative device for image forming apparatuses according to claim 8, further comprising correcting means for correcting said reference value based on the frequency of request for maintenance of said image forming apparatus from the user thereof.

10. An administrative device for image forming apparatuses according to claim 8, further comprising correcting means for correcting the membership function to be used in estimating risk by said estimating means according to erroneous judgment by said judging means.

11. An administrative device for image forming apparatuses according to claim 8, wherein said judging means changes said reference value during a period following maintenance of said image forming apparatus until a certain number of sheets are recorded.

12. An administrative device for image forming apparatuses, comprising:

receiving means for receiving number information regarding the number of sheets recorded on by the image forming apparatus and abnormality information;

first calculating means for calculating an accumulation curve of abnormalities based on the number information regarding the number of sheets recorded by the image forming apparatus received by said receiving means and abnormality information;

second calculating means for performing a plurality of filtering processes to the accumulation curve obtained by said first calculating means using a plurality of filters, so as to obtain a plurality of filter outputs;

estimating means for estimating the individual risk of occurrence of abnormalities for each filter, based on the plurality of filter outputs obtained by said second calculating means; and third calculating means for weighing the individual risk of occurrence of abnormalities for each of the plurality of filters estimated by said estimating means, so as to obtain risk relating to occurrence of abnormalities.

13. An administrative device for image forming apparatuses according to claim 12, wherein said estimating means makes fuzzy estimation of the risk of occurrence of abnormalities based on the filter output and a risk membership function.

14. An administrative device for image forming apparatuses according to claim 12, wherein said plurality of filters are filters in which the output linearly changes proportionately during differing periods of numbers of sheets recorded.

15. An administrative device for image forming apparatuses according to claim 12, wherein said second calculating means performs filtering processing for each filter at a plurality of differing accumulated number of recorded sheets, so as to obtain filter output.

16. An administrative device for image forming apparatuses according to claim 15, wherein said filtering process is performed according to the number of abnormalities within a period of time corresponding to a predetermined number of recording sheets.

17. An administrative device for image forming apparatuses according to claim 12, wherein said abnormality information includes an abnormality code indicating the type of abnormality, and the number of accumulated recording sheets at the time of occurrence of the abnormality.

18. An administrative device for image forming apparatuses according to claim 12, wherein said abnormality includes a paper jam.

19. An administrative device for image forming apparatuses according to claim 12, further comprising judging means for judging whether or not to perform maintenance of said image forming apparatus, based on the risk estimated by said estimating means and a predetermined reference value.

20. An administrative device for image forming apparatuses according to claim 19, further comprising correcting means for correcting said reference value based on the frequency of request for maintenance of said image forming apparatus from the user thereof.

21. An administrative device for image forming apparatuses according to claim 19, further comprising correcting means for correcting the membership function to be used in estimating risk by said estimating means according to erroneous judgment by said judging means.

22. An administrative device for image forming apparatuses according to claim 19, wherein said second calculating means performs filtering processes using only usable filters following maintenance of said image forming apparatus.

23. An administrative method for image forming apparatuses, comprising the steps of:

a) receiving number information regarding the number of sheets recorded on by the image forming apparatus and abnormality information;

b) calculating an accumulation curve of abnormalities based on the number information and the abnormality information;

c) performing filtering processing to the accumulation curve obtained in step (b), so as to obtain filter output; and d) estimating the risk of occurrence of abnormalities, based on filter output obtained in step (c).

24. An administrative method for image forming apparatuses according to claim 23, wherein step (d) makes fuzzy estimation of the risk of occurrence of abnormalities based on the filter output and a risk membership function.

25. An administrative method for image forming apparatuses according to claim 23, wherein said filtering processing is a filtering process in which the output linearly changes proportionately with change in the number of sheets recorded.

26. An administrative method for image forming apparatuses according to claim 23, wherein step (c) performs filtering processing for each filter at a plurality of differing accumulated number of recorded sheets, so as to obtain filter output, and calculates filter output.

27. An administrative method for image forming apparatuses according to claim 26, wherein said filtering processing is performed according to the number of abnormalities within a period of time corresponding to a certain number of recording sheets.

28. An administrative method for image forming apparatuses according to claim 23, wherein said abnormality information includes an abnormality code indicating the type of abnormality, and the number of accumulated recording sheets at the time of occurrence of the abnormality.

29. An administrative method for image forming apparatuses according to claim 23, wherein said abnormality includes a paper jam.

30. An administrative method for image forming apparatuses according to claim 23, further comprising step (e) for judging whether or not to perform maintenance of said image forming apparatus, based on the risk estimated by step (d) and a certain reference value.

31. An administrative method for image forming apparatuses according to claim 30, further comprising step (f) for correcting said reference value based on the frequency of request for maintenance of said image forming apparatus from the user thereof.

32. An administrative method for image forming apparatuses according to claim 30, further comprising step (g) for correcting the membership function to be used in estimating risk by step (d) according to erroneous judgment by step (e).

33. An administrative method for image forming apparatuses according to claim 30, wherein step (e) changes said reference value during a period following maintenance of said image forming apparatus until an image formation is performed on a certain number of sheets.

34. An administrative method for image forming apparatuses, comprising the steps of:

a) receiving number information regarding the number of sheets recorded on by the image forming apparatus and abnormality information;

b) calculating an accumulation curve of abnormalities based on the number information and the abnormality information;

c) performing filtering processing to the accumulation curve obtained in step (b) using a plurality of differing filters, so as to obtain a plurality of filter outputs;

d) estimating the individual risk of occurrence of abnormalities for each of the plurality of filters, based on the plurality of filter outputs obtained in step (c); and e) weighing the estimated individual risk of occurrence of abnormalities for each filter, so as to obtain risk relating to occurrence of abnormalities.

35. An administrative method for image forming apparatuses according to claim 34, wherein step (d) makes fuzzy estimation of the risk of occurrence of abnormalities based on the filter output and risk membership function.

36. An administrative method for image forming apparatuses according to claim 34, wherein said plurality of filters are filters in which the output linearly changes proportionately during differing periods of numbers of sheets recorded.

37. An administrative method for image forming apparatuses according to claim 35, wherein step (c) performs filtering processing for each filter at differing accumulated numbers of recorded sheets, so as to obtain filter output.

38. An administrative method for image forming apparatuses according to claim 37, wherein said filtering processing is performed according to the number of abnormalities within a period of time corresponding to a certain number of recording sheets.

39. An administrative method for image forming apparatuses according to claim 34, wherein said abnormality information includes an abnormality code indicating the type of abnormality, and the number of accumulated recording sheets at the time of occurrence of the abnormality.

40. An administrative method for image forming apparatuses according to claim 34, wherein said abnormality includes a paper jam.

41. An administrative method for image forming apparatuses according to claim 34, further comprising step (f) for judging whether or not to perform maintenance of said image forming apparatus, based on the risk estimated by step (e) and a reference value.

42. An administrative method for image forming apparatuses according to claim 41, further comprising step (g) for correcting said reference value based on the frequency of request for maintenance of said image forming apparatus from the user thereof.

43. An administrative method for image forming apparatuses according to claim 41, further comprising step (h) for correcting the membership function to be used in estimating individual risk by step (d) according to erroneous judgment by step (f).

44. An administrative method for image forming apparatuses according to claim 41, wherein step (c) performs filtering processing using only usable filters following maintenance of said image forming apparatus.

45. An administrative method for image forming apparatuses according to claim 44, wherein step (f) changes said reference value during a period following maintenance of said image forming apparatus until an image formation is performed on a certain number of sheets.

* * * * *

UNITED STATES PATENT AND TRADEMARK OFFICE

CERTIFICATE OF CORRECTION

PATENT NO. : 5,850,582

DATED : December 15, 1998

INVENTOR(S) : MASAAKI INOO, ET AL.

It is certified that error appears in the above-identified patent and that said Letters Patent is hereby corrected as shown below:

COLUMN 1,
Line 20, "of" should read --of the--.
COLUMN 3,
Line 4, "performing communication" should read --communicating--;
Line 5, "communicating" should read --communication--;
Line 60, count," should read --count--; and
Line 62, "identified" should read --identified from--.
COLUMN 4,
Line 15, "of" should read --or--.
COLUMN 5,
Line 23, "comprised" should read --comprised of--.
COLUMN 6,
Line 37, "arraignment" should read --arrangement--; and
Line 50, "provided" should read --providing--.

Signed and Sealed this

Nineteenth Day of October, 1999

*Attest:*

Q. TODD DICKINSON

*Attesting Officer*

*Acting Commissioner of Patents and Trademarks*